United States Patent [19]

Sougawa

[11] Patent Number: 4,784,090

[45] Date of Patent: Nov. 15, 1988

[54] INTAKE DEVICE FOR OUTBOARD ENGINE

[75] Inventor: Masafumi Sougawa, Hamamatsu, Japan

[73] Assignee: Sanshin Kogyo Kabushiki Kaisha, Hamamatsu, Japan

[21] Appl. No.: 68,220

[22] Filed: Jun. 30, 1987

[30] Foreign Application Priority Data

Jun. 30, 1986 [JP] Japan ..... 61-153416

[51] Int. Cl.[4] ..... F02B 75/18

[52] U.S. Cl. ..... 123/52 MV; 123/73 A

[58] Field of Search ..... 123/52 M, 52 MV, 52 MF, 123/52 MC, 73 A, 73 V

[56] References Cited

U.S. PATENT DOCUMENTS 3,269,374 8/1966 Conover ..... 123/73 DA

4;244,332 1/1981 Kusche et al. ..... 123/52 M 4,266,514 5/1981 Tyner ..... 123/73 R 4,345,551 8/1982 Bloemers ..... 123/73 A 4,440,697 4/1984 Sakurai ..... 123/52 M 4,702,202 10/1987 Hensel et al. ..... 123/52 M

*Primary Examiner*—Charles J. Myhre

*Assistant Examiner*—David A. Okonsky

*Attorney, Agent, or Firm*—Ernest A. Beutler

[57] ABSTRACT

An induction system for a two-cycle crankcase compression internal combustion engine of the type employed in an outboard motor. As such, the engine has vertically disposed crankcase chambers. Two barrel carburetors serve the crankcase chambers of the cylinder pairs through an intake manifold which has respective intake passages that each slope downwardly so as to avoid variations in mixture strength.

7 Claims, 2 Drawing Sheets

INTAKE DEVICE FOR OUTBOARD ENGINE

BACKGROUND OF THE INVENTION

This invention relates to an intake device for an outboard engine and more particularly to an improved induction system for a two-cycle crankcase compression engine having vertically disposed crankcase chambers.

Many multiple cylinder, two-cycle, crankcase compression, internal combustion engines operate with their cylinders and crankcase chambers vertically disposed relative to each other. This orientation is typical, for example, in an outboard motor wherein the engine has its crankshaft rotatable about a vertically extending axis. As a result, if multiple cylinders are employed normally one cylinder is spaced vertically above the other and the same is true with respect to the sealed crankcase chambers of the engine. This may be the case with either in line engines or the type of engines wherein the cylinder banks are staggered relative to each other so that the pistons and, accordingly, the crankcase chambers are vertically disposed one relative to the other.

There are advantages to providing a separate charge forming device for each crankcase chamber or, alternatively, an individual barrel of a multiple barrel carburetor serves each crankcase chamber. For example, a two barrel carburetor is employed to serve two vertically spaced crankcase chambers of an engine and the carburetor is disposed in a normal orientation so the carburetor barrels are disposed on the same horizontal plane. If the carburetor barrels are aligned with the center of the intake passage for the crankcase chambers, the manifold will have a passage that extends from one carburetor barrel upwardly to one crankcase chamber and a passage that extends from the other carburetor barrel downwardly to the other crankcase chamber.

In connection with a manifolding arrangement of the type described in the preceding paragraph, there can be difficulties in insuring good engine running due to the fact that the intake manifold passages slope in opposite directions to each other. A reason for this is that the fuel has a tendency to condense and there will be different amounts of back flow of the fuel depending upon the direction of inclination of the intake passages. As a result, previously proposed induction systems of this type have resulted in engines which run poorly under certain running conditions.

It is, therefore, a principal object of this invention to provide an improved induction system for a multiple chamber internal combustion engine of the two cycle crankcase compression type.

It is a further object of this invention to provide an induction system for a multiple chamber two-cycle crankcase compression internal combustion engine that permits the use of a two barrel carburetor and still achieves even running.

It is a further object of this invention to provide a system for insuring equal mixture strength to two adjacent cylinders of an engine having its output shaft rotating about a vertically extending axis.

SUMMARY OF THE INVENTION

This invention is adapted to be embodied in an induction system for a crankcase compression internal combustion engine having a pair of crankcase chambers which are vertically disposed relative to each other. An inlet is provided for the induction system which comprises a pair of side by side inlet openings disposed in a common horizontally extending plane. A charge forming system is incorporated for delivering a fuel air charge to each of the inlet openings. A first intake passage extends from one of the inlet openings downwardly to a first of the crankcase chambers and a second intake passage extends from the other of the inlet openings downwardly to the other of the crankcase chambers so that both of the inlet openings discharge in a downward direction to their respective crankcase chamber.

DETAILED DESCRIPTION OF THE PREFERRED EMBODIMENT OF THE INVENTION

Figure 1:
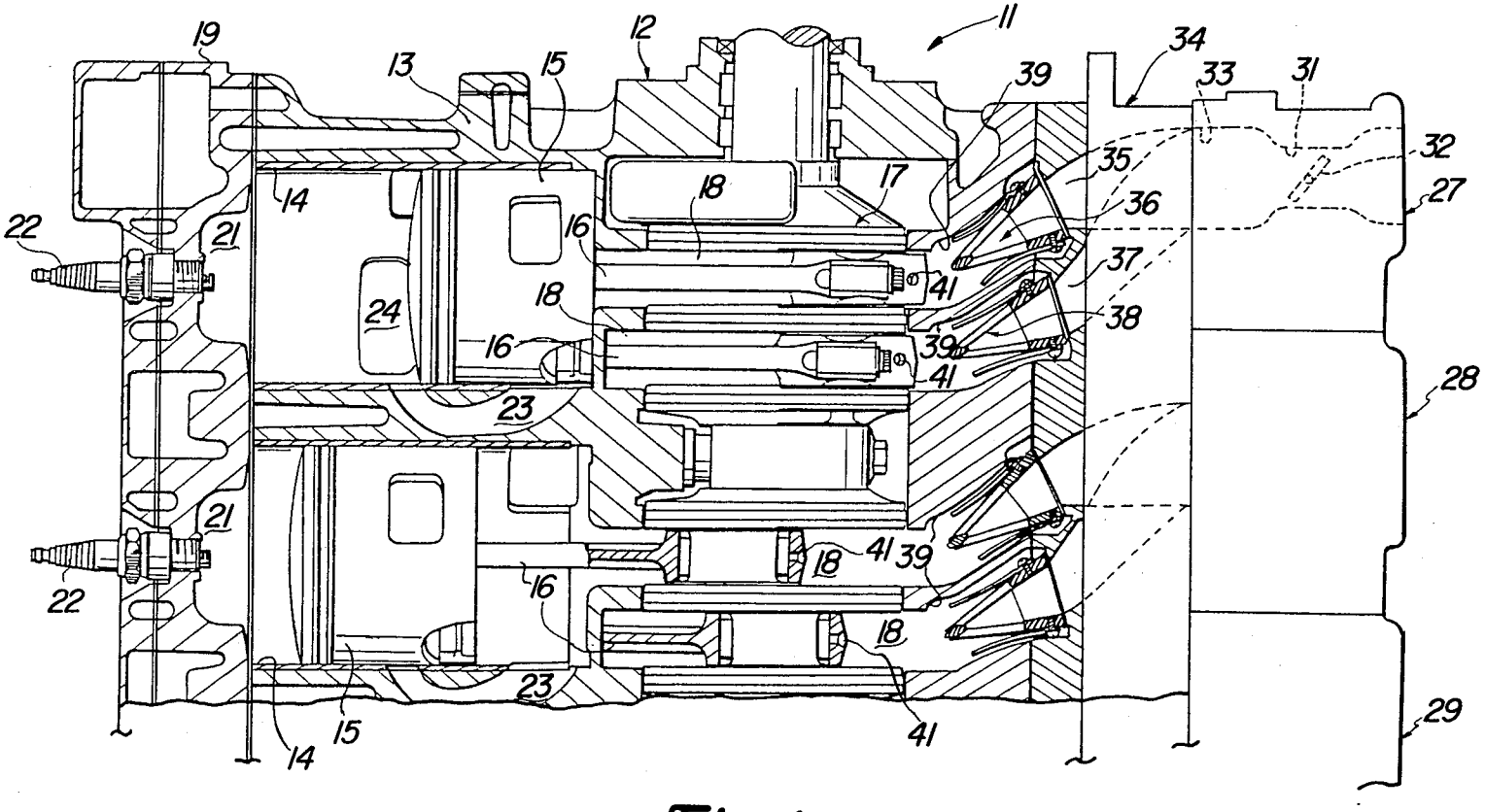
FIG. 1 is a side elevational view, with a portion shown in a vertical section, of a part of an outboard motor construction in accordance with an embodiment of the invention.

In the drawings the reference numeral 11 indicates generally a two-cycle crankcase compression internal combustion engine of the type employed for powering an outboard motor. Although the invention is described in conjunction with an outboard motor, it is to be understood that it may be practiced with other applications for such types of engines. However, the invention has particular utility in engines of the type having multiple cylinders and wherein the output shaft of the engine rotates about a vertically extending axis so that the cylinder crankcase chambers are vertically disposed relative to each other.

The engine 11 is depicted as being of the V-6 type. However, it is to be understood that the invention may be practiced with engines having a different number of cylinders or with engines having aligned cylinders. However, the invention has particular utility in conjunction with V-type engines wherein the cylinders of the individual cylinder banks are slightly staggered in a vertical direction.

The engine 11 includes a cylinder block 12 having angularly inclined cylinder banks 13. Each cylinder bank 13 is provided with a plurality of vertically spaced cylinder bores 14 which may be formed by liners inserted into the cylinder block 12. Pistons 15 are supported for reciprocation within the individual cylinder bores 14 and are connected by means of connecting rods 16 to a crankshaft 17. The crankshaft 17 is rotatably journaled within a crankcase chamber 18 for rotation about a vertically disposed axis in any known manner.

A cylinder head 19 is affixed to each of the cylinder banks 13 in a known manner. Each cylinder head 19 is formed with a plurality of recesses 21 which recesses 21 cooperate with the cylinder bores 14 and pistons 15 to form the combustion chambers. In addition, spark plugs 22 are supported within the cylinder heads 19 and have their gaps disposed in the recesses 21 for firing the charge in a known manner.

In accordance with normal two-cycle engine practice, the crankcase chamber 18 is divided into a plurality of individual, separate vertically spaced chambers each of which is associated with a respective one of the cylinders 14. These chambers are sealed from each other in a known manner. A fuel air charge is introduced to each of the sealed chambers through an induction system, to be described, when the associated piston is ascending within its cylinder bore 14. This charge is then compressed as the piston 15 moves downwardly and the compressed charge is transferred through one or more transfer passages 23 from the crankcase chambers to the area in the cylinder bore 14 above the head of the piston 15 for eventual firing.

Figure 2:
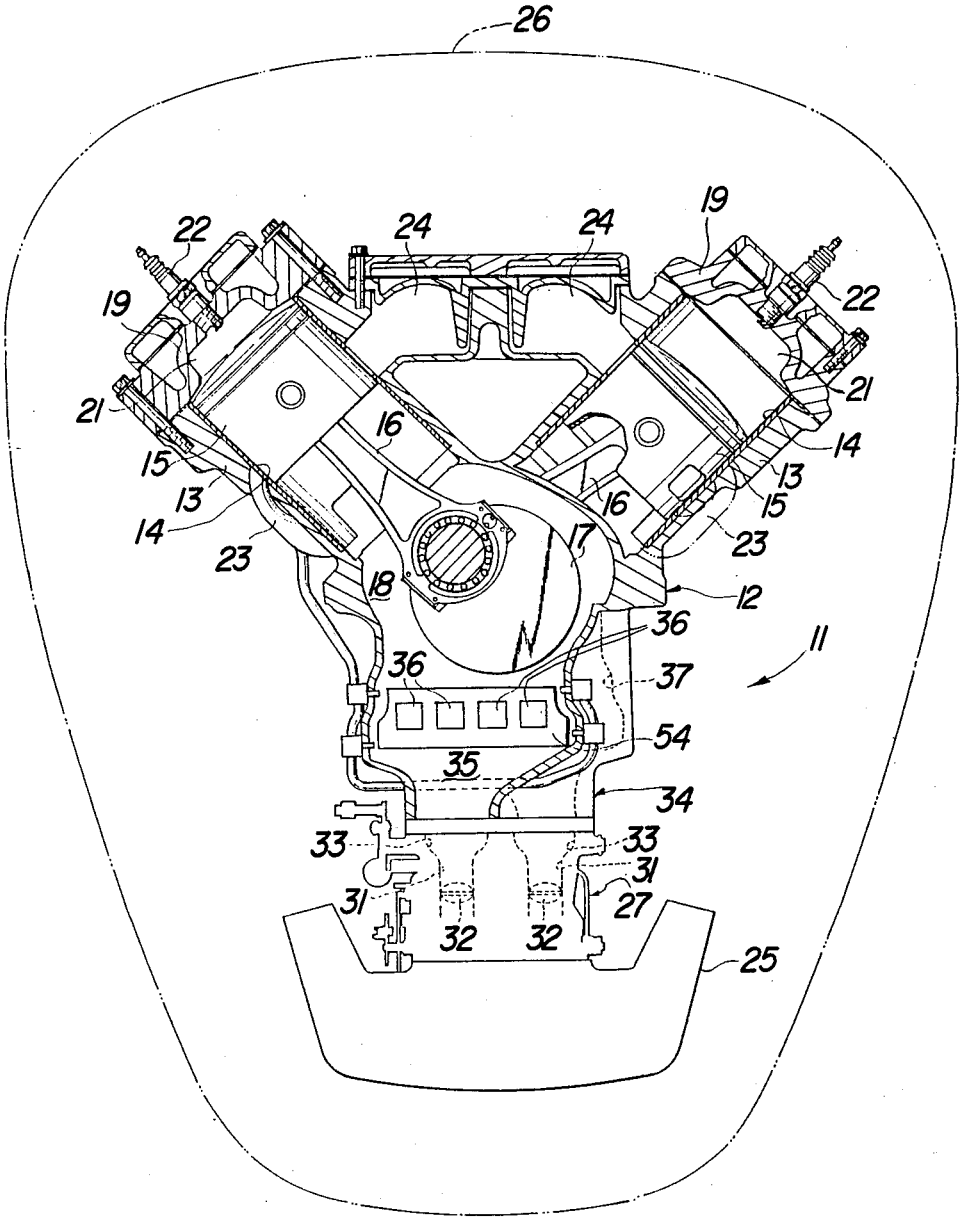
FIG. 2 is a top plan view, with portions shown in a horizontal cross-sectional plane, of the outboard motor.

The charge which has been burnt by firing of the spark plugs 21 is discharged from the individual combustion chambers through exhaust ports 24. The exhaust ports 24 are disposed in the bank of the V as shown in FIG. 2 and communicate with an exhaust manifold for discharge of the exhaust gases to the atmosphere. When the engine 11 is used in conjunction with an outboard motor, a typical underwater exhaust system of any known type (not shown) may be employed.

The induction system for the engine 11 includes an air intake device 25 that is disposed within a protective cowling, shown in phantom in FIG. 2 and identified by the reference numeral 26. The intake device 25 is designed so as to the silence the intake air and to distribute it to three vertically disposed, two barrel carburetors 27, 28 and 29. Each of the two barrel carburetors 27, 28 and 29 is provided with a pair of carburetor barrels or throats having venturi sections 31. The individual throats are disposed so that they lie on substantially the same horizontal plane. Throttle valves 32 are positoned at each of the throats 31 for controlling the flow through the individual carburetor barrels. The throttle valves 32 of all of the barrels of all of the carburetors 27, 28 and 29 are operated in unison by means of any suitable type of throttle mechanism.

Each carburetor barrel has an outlet opening 33 for discharge of the fuel air mixture to an intake manifold, indicated generally by the reference numeral 34. The intake manifold 34 is provided with pairs of intake passages which extend from each of the carburetors 27, 28 and 29 to paired cylinders of the engine 11. One cylinder of each pair is formed from each cylinder bank and the charge is delivered to the sealed crankcase chamber 18 of the respective cylinder through the intake manifold 34 in a manner now to be described.

Paired intake passages of the manifold 34 includes a first intake passage 35 that extends from one of the carburetor barrel discharge openings 33 downwardly and rearwardly to the upper most crankcase chamber 18 of the cylinder pair. A read type check valve indicated by the reference numeral 36 is interposed at the discharge end of the manifold 34 so as to prevent reverse flow. As may be readily seen from FIG. 1, each read type check valve 36 is of the V-type and is disposed so that it is inclined in a rearward and downward direction.

Manifold 34 also includes a second intake passage 37 of each pair which extends from the carburetor barrel discharge opening 33 downwardly and rearwardly to the other, lower most crankcase chamber 18 of the cylinder pair. A read type check valve assembly 38 is disposed at the outlet end of the manifold passages 37 so as to prevent reverse flow. The check valves 38 are, like the check valves 36, of the V-type and are generally disposed so that they extend downwardly and rearwardly. This downward and rearward configuration insures that any condensed fuel and or lubricant, if lubricant is mixed with the fuel, will be delivered to the crankcase chambers by gravity flow.

The crankcase chambers are provided with individual openings which form extensions of the manifold passages 35 and 37 and which have an arcuately curved surface 39 that is disposed so as to intersect the flow of fuel and direct it toward a lubricant passage 41 formed in the big end portion of each of the connecting rod 16 for directing lubricant to the connecting rod so as to lubricate them.

It should be readily apparent that the described construction is such that all of the manifold passage ways extend in a downward direction and this avoids any irregularities in runnings due to uneven mixture strength being delivered to the individual crankcase chambers. Also, the configuration permits a compact overall arrangement of the carburetors in vertically disposed fashion while still insuring good running.

Although the invention has been described in conjunction with a preferred embodiment of the invention, it should be obvious to those skilled in the art that various changes and modifications may be made without departing from the spirit and scope of the invention, as defined by the appended claims.

I claim:

1. An induction system for a crankcase compression internal combustion engine having a crankcase defining a pair of crankcase chambers vertically disposed relative to each other and each having a respective inlet, an inlet for said induction system comprising a pair of side by side inlet openings disposed in a common horizontally extending plane spaced a substantial distance above said crankcase inlets, charge forming means for delivering a fuel air mixture to each of said inlet openings, and a manifold affixed to said crankcase and defining a first intake passage extending from one of said inlet openings downwardly to a first of said crankcase chamber inlets and a second intake passage extending from the other of said inlet openings downwardly to the other of said crankcase chamber inlets.

2. An induction system as set forth in claim 1 wherein the charge forming means comprises a two barrel carburetor having each of its carburetor barrels discharging into a respective one of the inlet openings.

3. An induction system as set forth in claim 1 wherein the crankcase inlets are directed toward the connecting rods of the engine when the pistons associated with said connecting rods are at their bottom dead center position for directing the flow of inlet charge to said connecting rods for lubricating said connecting rods.

4. An induction system as set forth in claim 1 wherein the manifold has the inlet openings disposed in side by side fashion.

5. An induction system as set forth in claim 4 further including check valves disposed in each of the intake passages.

6. An induction system as set forth in claim 5 wherein the check valves are of the V-type and are disposed so that the apex of their V is disposed at the lower end thereof.

7. An induction system as set forth in claim 6 wherein the charge forming means comprises a two barrel carburetor having each of its carburetor barrels discharging into a respective one of the inlet openings.

* * * * *